US006145517A

United States Patent [19]

Mancuso

[11] Patent Number: 6,145,517

[45] Date of Patent: Nov. 14, 2000

[54] METHOD OF REMOVING AGGLOMERATIONS OF POLYETHYLENE FROM REACTOR

[75] Inventor: Matthew A. Mancuso, New Kensington, Pa.

[73] Assignee: Keibler-Thompson Corp., New Kensington, Pa.

[21] Appl. No.: 09/298,062

[22] Filed: Apr. 22, 1999

Related U.S. Application Data

[60] Provisional application No. 60/084,957, May 11, 1998.

[51] Int. Cl.[7] ..... B08B 9/00

[52] U.S. Cl. ..... 134/22.1; 74/490.01; 37/461; 414/209; 901/2

[58] Field of Search ..... 134/22.1; 37/461; 209/74; 74/490.01; 901/2; 414/209

[56] References Cited

U.S. PATENT DOCUMENTS

| | | | |
|---|---|---|---|
| 2,973,107 | 2/1961 | Chérel | 214/1 |
| 3,033,059 | 5/1962 | Melton et al. | 74/801 |
| 3,323,234 | 6/1967 | Pickrell | 37/103 |
| 3,587,872 | 6/1971 | Pauly | 214/1 |
| 3,737,059 | 6/1973 | Peterson et al. | 214/145 |
| 4,220,170 | 9/1980 | Hebert et al. | 134/167 |
| 4,327,943 | 5/1982 | Longo | 294/70 |
| 4,381,872 | 5/1983 | Hahn | 294/70 |
| 4,501,522 | 2/1985 | Causer et al. | 414/4 |
| 4,545,723 | 10/1985 | Clark | 414/730 |
| 4,588,790 | 5/1986 | Jenkins, III et al. | 526/70 |
| 4,822,238 | 4/1989 | Kwech | 414/730 |
| 5,223,280 | 6/1993 | Ogata et al. | 425/436 |

OTHER PUBLICATIONS

Encyclopedia of Polymer Science and Engineering 2nd[Ed.] vol. 7; pp. 480–488; Gas Phase Polymerization (Wiley), 1987.

*Primary Examiner*—Robert J. Popovics
*Attorney, Agent, or Firm*—Andrew Alexander

[57] ABSTRACT

A method of removing a solidified body of polyethylene from a Unipol reactor using a robotic apparatus extended through a porthole on top of the reactor.

17 Claims, 5 Drawing Sheets

METHOD OF REMOVING AGGLOMERATIONS OF POLYETHYLENE FROM REACTOR

CROSS REFERENCE TO RELATED APPLICATION

This application claims the benefit of U.S. Provisional Application Ser. No. 60/084,957, filed May 11, 1998, incorporated herein by reference.

BACKGROUND OF THE INVENTION

This invention relates to polyethylene production and more particularly, it relates to a procedure for effective removal of polyethylene build-up or agglomeration of polyethylene from a Unipol reactor.

Low density polyethylene is the first of the polyolefins prepared by the polymerization of ethylene. Low density polyethylene is a plastic material commonly used in products such as plastic bottles, garbage bags and insulating covers for electrical wires. During the reaction, the reactants are maintained at a temperature of about 250° to 300° F. under high pressure. After formation, the polyethylene is present in small fluidized particles and thus is flowable.

Low density polyethylene (LDPE) and linear low density polyethylene (LLDPE) are produced by the Unipol process developed by Union Carbide. The production of such polyethylene takes place in a low pressure vessel, about 14 feet in diameter and 80 feet high, referred to as a Unipol reactor. The reactor has the problem that sometimes the exothermic reaction will heat up, excessively melting particles of polyethylene, leaving a solidified mass of polyethylene in the reactor. When this happens, the reactor cannot be restarted and thus the mass of solid polyethylene must be removed.

The solidified mass of polyethylene in the Unipol reactor is extremely difficult to remove because of the large quantity. Operators have resorted to dangerous procedures to facilitate its removal. For example, explosives have been used in an attempt to disintegrate the congealed mass into smaller pieces with only limited success. Also, chain saws have been used sometimes in conjunction with the explosives. The explosives have the problem that they are unpredictable and dangerous and often rupture the side of the reactor. The chainsaws are also dangerous and can result in serious accidents. Further, the blades of the saws require constant changing because of the gummy nature of the polyethylene. These problems are compounded because operators must physically enter the reactors This requires protective gear and a fresh air supply to protect the operators. After small particles agglomerate, the temperature remains high for a long period before cooling and solidifying. Thus, the whole operation is very time consuming, cutting into productivity and resulting in costly down time. It will be seen that there is a great need for a method and apparatus which efficiently removes the solidified mass of polyethylene from the Unipol reactor.

In the patent art, different mechanical apparatus have been suggested for working inside vessels. For example, U.S. Pat. No. 4,822,238 discloses a robotic arm positionable within a nuclear vessel by access through a small diameter opening and having a mounting tube supported within the vessel and mounting a plurality of arm sections for movement lengthwise of the mounting tube as well as for movement out of a window provided in the wall of the mounting tube. An end effector, such as a grinding head or welding element, at an operating end of the robotic arm, can be located and operated within the nuclear vessel through movement derived from six different axes of motion provided by mounting and drive connections between arm sections of the robotic arm.

U.S. Pat. No. 4,501,522 discloses a manipulator for remote handling in a hostile environment, the manipulator having a slave aim comprising an upper arm, a forearm and a jaw mechanism. The upper aim is pivotally suspended from a shoulder support and is telescopically extendible such that straight line motion of the forearm is readily obtained. In addition the forearm is arranged to pivot relative to the upper arm through the same angle as the upper arm but in the opposite sense such that the forearm maintains a constant orientation when the upper arm pivots.

U.S. Pat. No. 4,381,872 discloses a single hoist line operated clamshell bucket apparatus and method of use. The bucket apparatus is loaded in the usual manner at a first location for transporting bulk material to a second location where it is discharged. The bucket is discharged by sensing the presence of a preselected radio command signal that is controlled by the crane operator. The sensed radio signal operates a shut-off valve in a hydraulic controlled bucket latching system to release hydraulic fluid to permit discharge of the clamshell bucket.

U.S. Pat. No. 2,973,107 discloses a remote controlled manipulating apparatus for manipulating objects inside sealed chambers referred to as a telemanipulator which comprises a first group of control units which are outside a sealed chamber and which actuate at least one second group of corresponding operating units inside the chamber, and, according to the invention, is essentially characterized in this, that the connection between the above mentioned two groups of units is effected by means of at least one transmission system known per se and comprising on the one hand a first movable magnet disposed outside and against the wall of the chamber, which wall is made of non-magnetic material, and on the other hand a second magnet disposed inside and against the wall of the chamber.

U.S. Pat. No. 3,033,059 discloses a drive means for a remote control manipulator which comprises two main portions. The position containing the motor and speed reducer being designated as the drive portion, and a pivoted member or a member connected to the output shaft of the speed reducer and rotated thereby, which is the driven portion. In operation, with the drive portion fixed, it is the driven portion that is pivoted. If, however, the driven portion is fixed then the drive portion pivots. In each case the output shaft of the speed reducer serves as the pivotal axis and driving member for the pivoted joint.

U.S. Pat. No. 3,323,234 discloses an earth excavating apparatus having a detachable track that clamps to the periphery of the utility pole at a desired distance above the ground. A carriage, riding on the track, supports an extensible means which, in the embodiment chosen for illustration, takes the form of a hydraulic piston and cylinder. The opposite end of the piston and cylinder are connected to a novel scoop arrangement which is hydraulically operated and capable of scooping earth close to the surface of the pole.

U.S. Pat. No. 3,587,872 discloses a mechanical arm provided with a free end having gripping jaws thereon, and a pair of foot pedals connected by Bowden wires to the various elements to control swinging movement of the elements of the arm both vertically and horizontally and controlling opening and closing movements of the jaw members.

U.S. Pat. No. 3,737,059 discloses a multi-purpose bucket arrangement comprised of a first bucket portion and a second or cover bucket portion pivotally mounted thereon. A pair of hydraulic cylinders are operatively connected to the bucket portions to normally pivot the second bucket portion relative to the first one. The rod ends of the cylinders are pivotally connected to the distal end of a lever mounted on the pivotal connection for the bucket portions.

U.S. Pat. No. 4,220,170 discloses an apparatus for cleaning large tank interiors and other similar areas having a telescoping boom assembly attached to a base assembly with a positionable water nozzle assembly attached to one end of the boom assembly wherein the base member positioned in the tank interior is provided with a cage area housing the necessary control equipment and human operator.

U.S. Pat. No. 4,327,943 discloses a pair of bucket bowls pivotally suspended from a power head frame on the exterior of which is mounted a pair of hydraulic rams. Each of the hydraulic rams has one end pivotally connected to the power head frame and another end pivotally connected to a respective bucket bowl. The power head frame houses power components for actuating the cams and is formed of a horizontal deck, and vertical side and end bulkheads integrally formed to provide a watertight enclosure.

U.S. Pat. No. 4,545,723 discloses apparatus for adapting a general purpose end effector device to a special purpose end effector which includes an adapter bracket assembly which provides a mechanical and electrical interface between the end effector devices. The adapter bracket assembly includes an adapter connector post which interlocks with a diamond-shaped gripping channel formed in closed jaws and of the general purpose end effector. The angularly intersecting surfaces of the connector post and gripping channel prevent any relative movement therebetween. Containment webs constrain the outer finger plates of the general purpose jaws to prevent pitch motion. Electrical interface is provided by conical, self-aligning electrical connector components carried by respective ones of said end effectors.

U.S. Pat. No. 5,223,280 discloses an apparatus for taking residual solid matter out of an extrusion head of an extruder including a grasping device for grasping residual solid matter in the extrusion head, and a moving device for moving the grasping device between a grasping position in the extrusion head and an exhausting position on one side of the extrusion head. In order to remove the residual solid matter from the grasping device even if the solid matter firmly adheres to the grasping device, the apparatus further includes a disengaging device for urging the residual solid matter to disengage it from the grasping device when the grasping device has arrived at the exhausting position and released the residual solid matter. A control device is provided for controlling the grasping device, the moving device and the disengaging device.

In spite of these disclosures, there is still a great need for a device for removing solidified polyethylene from a Unipol reactor which efficiently and effectively removes the solidified material in the reactor with minimal downtime and without endangering the operators. Thus, the subject invention provides such a device.

SUMMARY OF THE INVENTION

It is an object of this invention to provide a robotic apparatus for the efficient removal of solidified polyethylene from a Unipol reactor.

It is another object of this invention to provide a mechanical or robotic method and apparatus for removing solidified polyethylene from a low pressure reactor.

Yet, it is another object of this invention to provide a robotic arm that can be inserted through a top opening of a Unipol reactor for removing solidified material therefrom.

And, yet it is another object of the invention to provide a mechanical arm that can be operated by remote control for removing solidified material from a low pressure reactor.

These and other objects will become apparent from a reading of the specification and claims appended hereto.

In accordance with these objects, there is provided a method of removing a solidified body of polyethylene from a reactor used for making polyethylene from ethylene gas and a catalyst, the solidified body resulting from overheating of the reactor and melting or agglomerating polyethylene particles into said solidified body. The method comprises providing a reactor having a lower chamber and an upper chamber, the lower chamber having portholes therein and the upper chamber having a top porthole, the solidified body of polyethylene having a surface and contained in the lower chamber. In the method, a robotic apparatus is extended through the top porthole, the apparatus adapted to extend to the top surface of the solidified body of polyethylene. The apparatus comprises a shaft extending through the top porthole into the reactor, the shaft movable upwardly and downwardly through the porthole. Legs attached to the shaft inside the reactor are adapted to extend to an inside wall of the reactor for purposes of limiting lateral movement of the shaft. A bearing is provided on a lower end of the shaft for supporting an arm system having a first end attached or supported by the bearing and a second end rotatably attached to a clamshell bucket comprised of two jaws. Hydraulic means is rotatably connected to the arm system and to the jaws adapted for opening and closing the jaws. The robotic apparatus is manipulated to cut a portion from the surface of the solidified body of polyethylene using the jaws of the clamshell bucket. The portion of the polyethylene body is removed from the reactor through the portholes in the lower chamber, thereby removing the solidified body of polyethylene from the reactor.

DETAILED DESCRIPTION OF THE PREFERRED EMBODIMENTS

Figure 1:
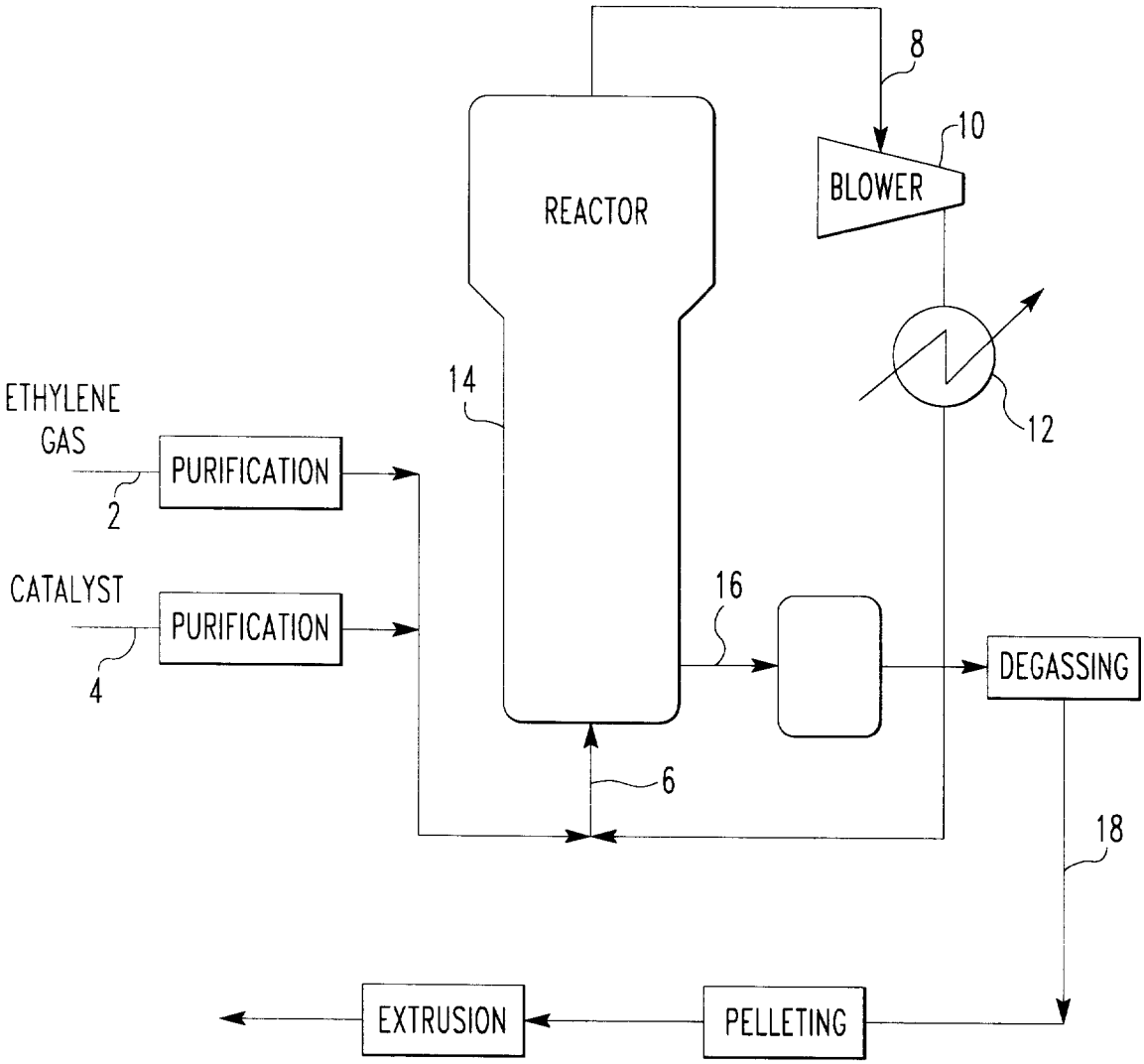
FIG. 1 is a schematic of the Unipol process for making polyethylene.

Referring now to FIG. 1, there is provided a schematic of the Unipol process for producing polyethylene. Ethylene feed gas is added along line 2 and a catalyst initiator system is added along line 4 and both are added to reactor 14 along line 6 after purification and mixing. Polymerization is accomplished at elevated temperature and under high pressure, for example 100–300 psi. The gaseous reactants enter the bottom of the reactor and provide mixing and fluidization. Unreacted ethylene gas is removed from the top of the reactor and recycled along line 8 where it is passed through a blower 10 and a cooler 12 before being re-introduced along line 6 to reactor 14. High or low density polyethylene product is removed along line 16 where it is degassed before being removed along line 18 for purposes of pelletizing and extrusions. Because the product is fluidized, it is easily removed. Since the reaction is exothermic in nature, temperature for the process is very important. Without temperature control, the reactants can reach a temperature well above the melting temperature of the polymer resulting in agglomeration of the fluidized bed at a very high temperature requiring shut down of the process. The agglomerated products must be removed before production can be resumed. Because of the high temperature, downtime can be extensive when conventional removal techniques are employed.

Figure 2:
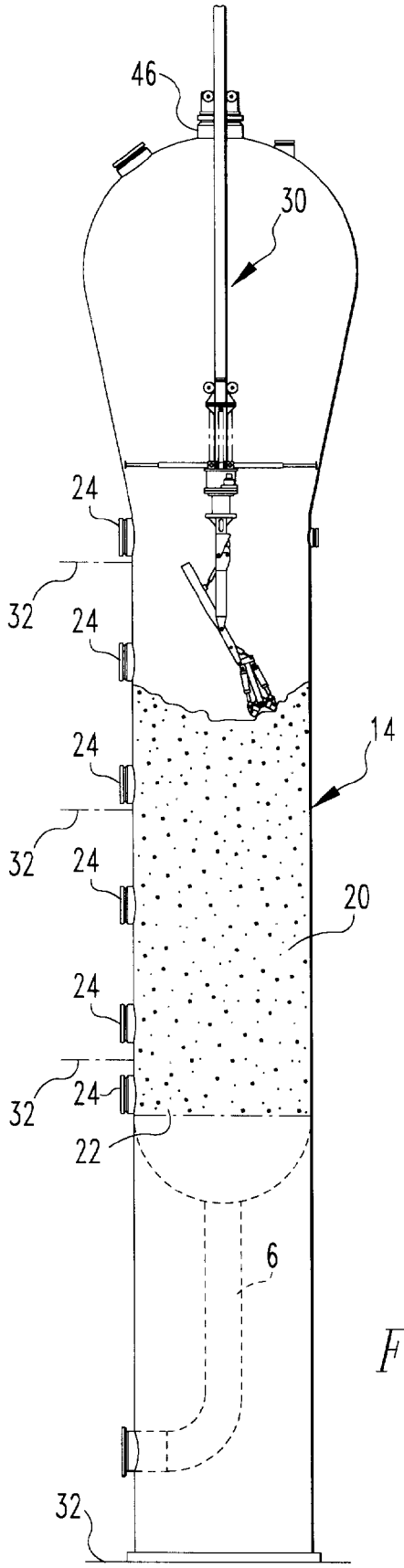
FIG. 2 is a cross-sectional view of the Unipol reactor substantially full of solidified reactant showing the apparatus for removing the solidified material.

In accordance with the invention, in FIG. 2, there is shown Unipol reactor 14 containing solidified polyethylene 20. Also, shown in outline form is line 6 for introducing reactants through perforated bottom 22. Reactor 14 is shown with a series of portholes 24. It should be noted that the reactor is about 80 feet high and thus extends through a number of floors 32 usually with at least one porthole on each floor. Also, shown in FIG. 2 is a robotic apparatus, generally referred to as 30, having an arm member, support system, and clamshell bucket attached thereto for cutting and removing solidified polyethylene in accordance with the invention.

Figure 3:
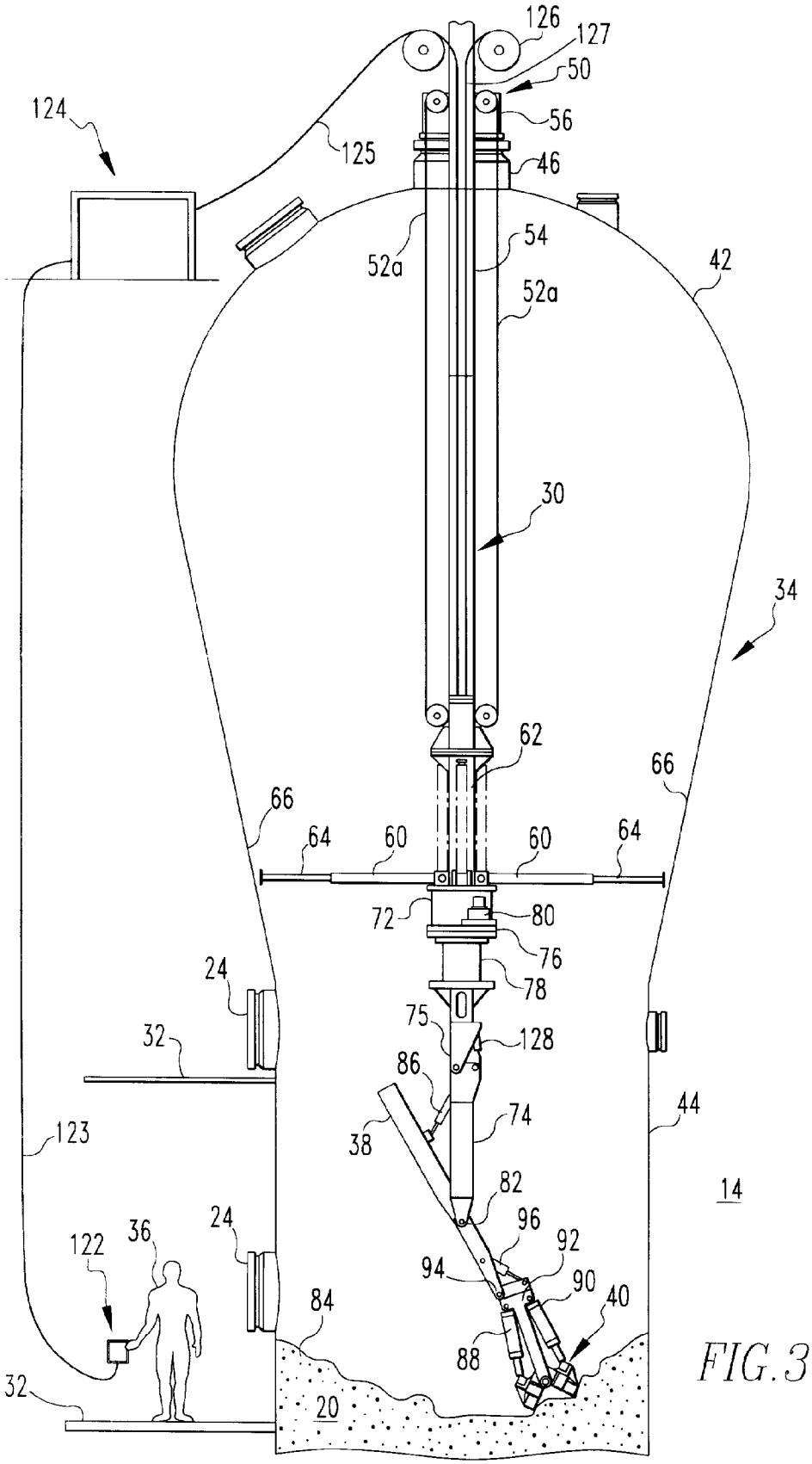
FIG. 3 is an enlarged view of the top portion or chamber of the reactor and the robotic apparatus of the invention.

In FIG. 3, there is shown an enlarged view of upper portion 34 of Unipol reactor 14. An operator 36 is shown standing on floor 32. Operator 36 has the ability to observe robotic arm and clamshell bucket 40 through porthole 24 as the operator uses pendant control box 122 to cut and remove solidified polyethylene.

Pendant control box 122 is connected to portable hydraulic power unit 124 by control wiring 123 to actuate solenoid controlled hydraulic valves on the hydraulic power unit. The solenoid valves convey hydraulic fluid through hydraulic hoses 125, hydraulic take-up reels 126, and additional hydraulic hoses 127 to pressurize the hydraulic cylinders and hydraulic motor 86, 88, 96, 90 and 80. A single water line (not shown) is also routed in this manner to spray nozzle 119 shown in FIG. 4.

In FIG. 3, upper portion 34 is shown having a dome-shaped top 42 joined to a generally cylindrical bottom 44 which contains the solidified polyethylene. For purposes of removing solidified polyethylene after the reactor shuts down, robotic apparatus or device 30 is lowered into the reactor through top porthole 46. Robotic apparatus 30 can be raised or lowered by vertical drive mechanism 50 which is engaged by top porthole 46. Vertical drive mechanism 50 has winches 52 with cables 52*a* attached to extension 54. Winches 52 may be turned by hydraulic motor 56 to raise or lower the robotic apparatus to permit clamshell bucket 40 to contact polyethylene surface 84 for effective removal.

Thus, robotic device 30 is comprised of an extension 54 which operates to raise or lower clamshell bucket 40. It will be appreciated that additional extensions can be provided to further lower clamshell bucket 40 into the reactor for removal of solidified polyethylene.

From FIG. 3, it will be seen that robotic device or apparatus 30 is comprised of preferably four outriggers or legs 60 which are provided to fixedly position apparatus 30 in the reactor. Outriggers 60 can be folded upwardly against central shaft 62 for purposes of introducing or retrieving robotic apparatus 30 from reactor 14 through porthole 46. Further, when first placed in the reactor, outriggers 60 are hydraulically lowered from the vertical plane to the horizontal position. Hydraulically activated telescopic extensions 64 are extended radially outwardly to engage inside surface 66 of top 42. Legs 60 ensure that robotic device 30 is securely positioned in the approximate center of the reactor. That is, legs 60 ensure that apparatus 30 does not move laterally when, for example, boom or lever member 38 moves clamshell bucket 40.

Robotic device 30 is further comprised of second support member or boom 38 and first support member 74 for supporting boom 38 and clamshell bucket 40. First support member 74 is rotatably attached under outriggers 30 to a central shaft 72. It will be noted that central shaft 72 also provides support for outriggers 60. Central shaft 72 provides a bearing support 76 for second shaft or arm 78 and second shaft 78 is turned or rotated by means of motor 80 mounted on central shaft 72. Second shaft 78 is maintained to provide for 360° rotation of first support member 74 and boom 38. Also, first support member 74 is mounted to arm member 78 at swivel point 75 to permit member 74 to tilt from the vertical up to about 30°. Member 74 can be tilted by means of a hydraulic cylinder 128. Boom or lever 38 is rotatable mounted to first support member 74 at swivel 82 which permits boom 38 to travel through an arc of about 138°. Thus, clamshell bracket 40 can traverse the surface area 84 of the solidified polyethylene.

Boom 38 is also a telescopic member which provides for short travel distances for clamshell bucket 40 to and from surface 84 of the solidified polyethylene. Boom 38 is activated or moved through a 138° arc from a vertical plane by action of hydraulic cylinder 86. Also, clamshell bucket is opened and closed by hydraulic cylinders 88 and 90 mounted on third support member 92. In addition, clamshell bucket 40 and member 92 can rotate on swivel about point 94 by hydraulic cylinder 96 to provide for added manipulation of clamshell bucket 40 within reactor 14. That is, clamshell bucket 40 and member 92 can be rotated up to 120° about swivel point 94.

Figure 4:
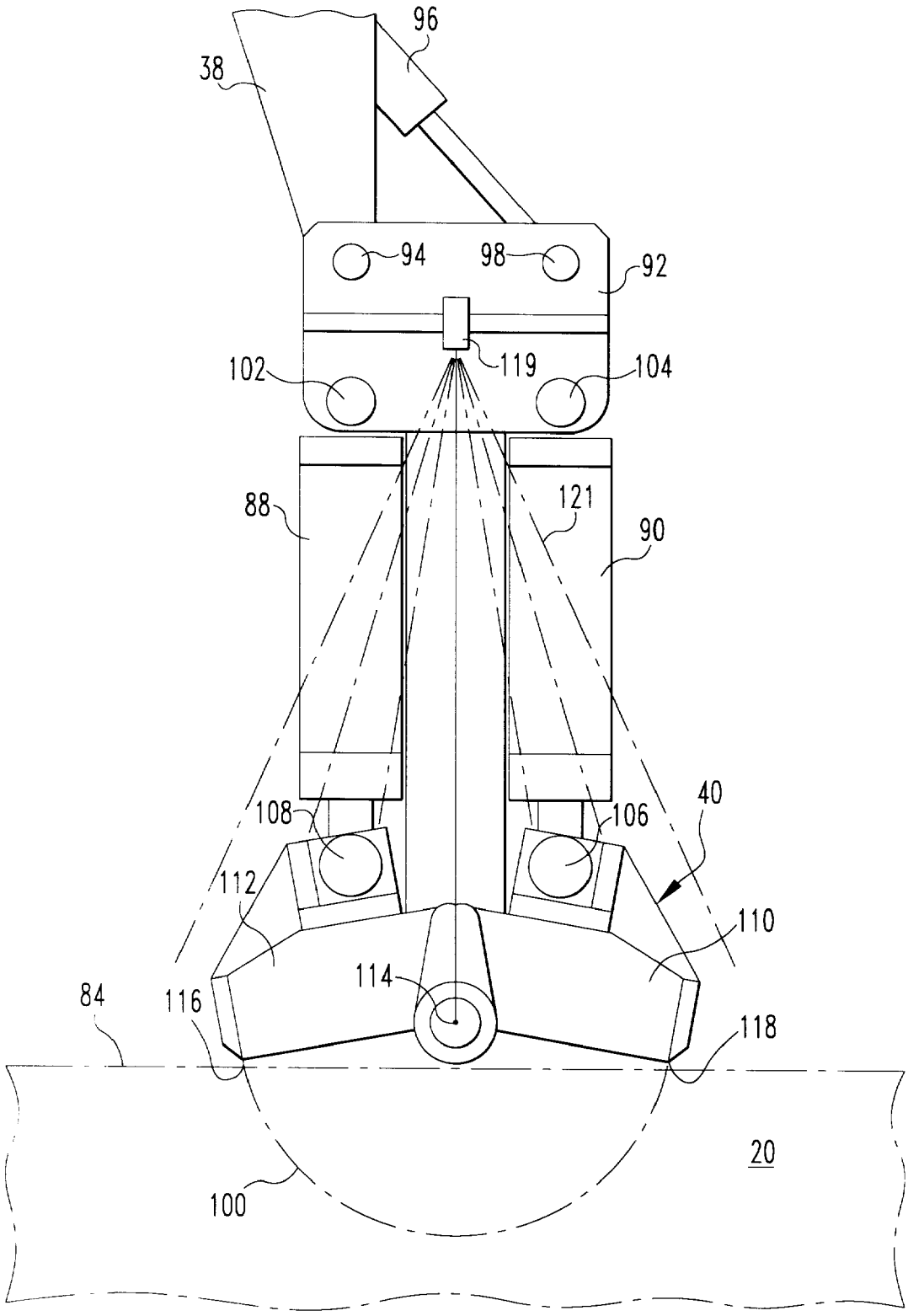
FIG. 4 is an enlarged view of a clamshell bucket in the open position.

FIG. 4 provides an enlarged view of clamshell bucket 40 and third support member 92 swively mounted at 94 on boom or second support member 38. Also shown is hydraulic cylinder 96 rotatably attached at 98 to member 92. It will be noted that clamshell bucket 40 is in the open position and located above surface 84 of solidified polyethylene 20. Line 100 shows the amount of polyethylene to be removed when clamshell bracket 40 is closed.

Hydraulic cylinders 88 and 90 are rotatably attached to third support member 92 at swivel points 102 and 104, respectively. Also, hydraulic cylinders 88 and 90 are rotatably attached to clamshell bucket 40 at swivel points 106 and 108. The swivel points permit the hydraulic cylinders to move as the clamshell bucket is closed as shown in FIG. 5.

Clamshell bucket 40 is comprised of two jaws 110 and 112 which rotate about swivel point 114 when the jaws are closed to cut into the solidified polyethylene. Jaws 110 and 112 are provided with sharp edges 116 and 118 for ease of cutting through the polyethylene. Also, it should be noted that nozzle 119 is provided to spray, for example, water 121 on the polyethylene to provide for cooling and avoiding sticking of the material to clamshell bucket 40.

Figure 5:
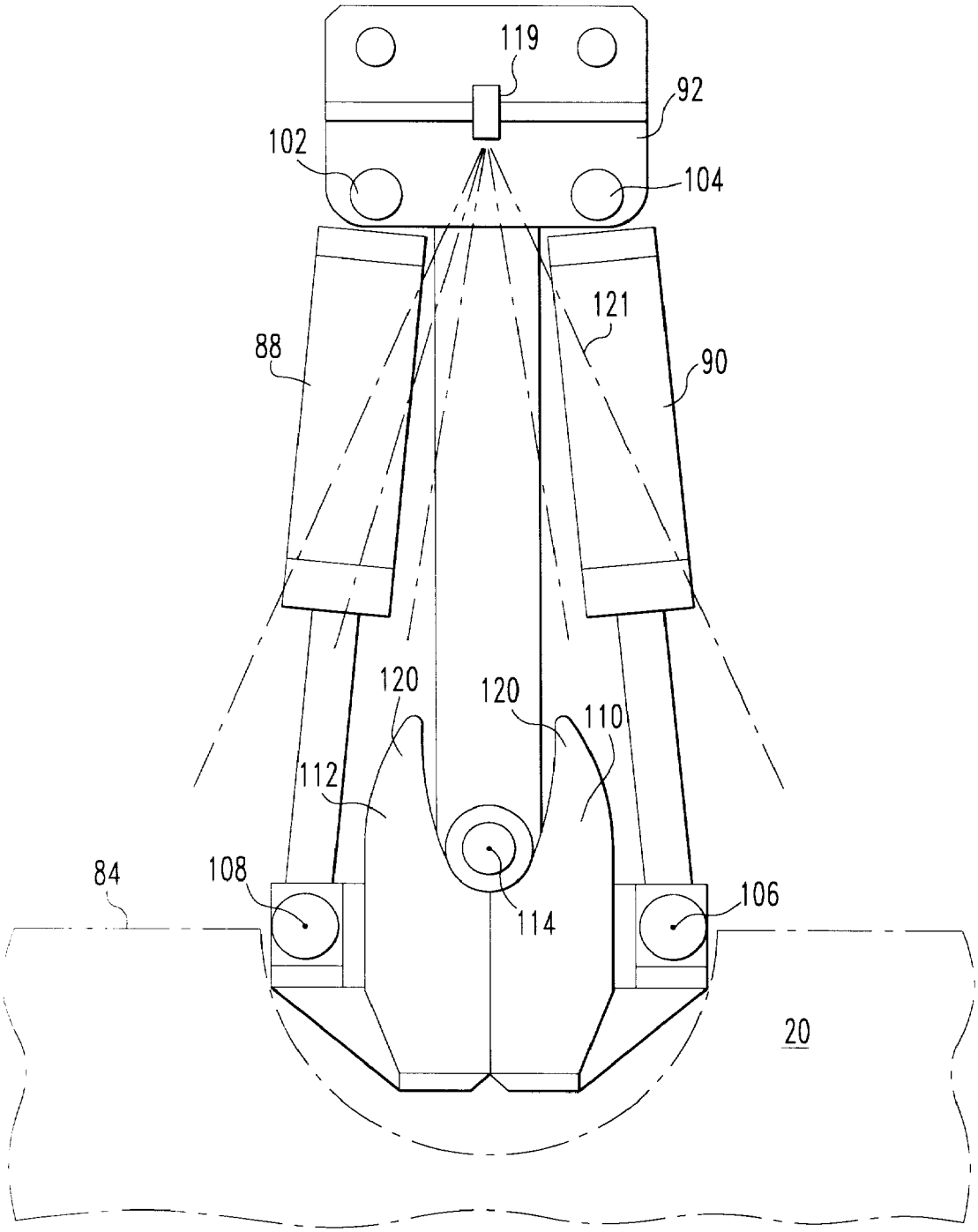
FIG. 5 is an enlarged view of the clamshell bucket in the closed position.

FIG. 5 shows clamshell bucket 40 closed and containing a body 120 of polyethylene cut from solidified polyethylene 20. Clamshell bucket 40 and body 120 can be retracted and transferred to porthole 24 where it can be discharged. A conveyor or chute (not shown) can be provided through porthole 24 for aiding in quickly removing bodies of solidified polyethylene.

In operation, robotic arm 30 is first lowered through porthole 46 as needed and outrigger legs 60 are extended to anchor the robotic arm against side 66 of top 42. Remote operator 36 using remote pendant control box 122 operates clamshell bucket 40 to cut bodies 120 and pass them through porthole 24 or place them on a conveyor belt or chute which carries the bodies through the porthole. As the solidified polyethylene is removed, outriggers 60 are retracted and extension 54 is lowered further into the reactor. Also, second support member 38 can be moved telescopically to provide for small adjustments of clamshell bucket 40.

The present invention has the advantage that it quickly and efficiently removes solidified polyethylene from a Unipol reactor. In addition, the invention has the advantage that it can be operated while the body of solidified polyethylene is hot. Further, the invention has the advantage that the operator is remote from the reactor while the solidified polyethylene is being removed. After the reactor has been emptied, the robotic arm can be removed and reused at another reactor, if necessary.

While the invention has been described with respect to solid polyethylene, it will be appreciated that the invention can be used in other reactors and furnaces and the like for purposes of cleaning and removing unwanted materials, and such uses are contemplated within the purview of the invention.

What is claimed is:

1. A method of removing a solidified body of polyethylene from a reactor used for making polyethylene from ethylene gas and a catalyst, the solidified body resulting from overheating of the reactor, melting or agglomerating polyethylene particles into said solidified body, the method comprising:

(a) providing a reactor having a lower chamber and an upper chamber, said lower chamber having portholes therein and said upper chamber having a top porthole, said solidified body of polyethylene having a surface and contained in said lower chamber;

(b) extending a robotic apparatus through said top porthole, said apparatus adapted to extend to said surface of the solidified body of polyethylene, said apparatus comprising:

(i) a shaft extending through said top porthole into said reactor said shaft movable upwardly and downwardly through said porthole;

(ii) legs attached to a lower portion to said shaft inside said reactor said legs adapted to extend to an inside wall of said reactor for purposes of limiting lateral movement of said shaft;

(iii) a bearing provided on a lower end of said shaft, said bearing supporting an arm system having a first end attached thereto and having a second end pivotally attached to a clamshell bucket comprised of two jaws; and (iv) hydraulic means pivotally attached to said arm system and to said jaws adapted for opening and closing said jaws;

(c) manipulating said robotic apparatus to cut a portion of said solidified body of polyethylene using said jaws; and (d) removing said portion of said polyethylene body from said reactor through the portholes in said lower chamber, thereby removing said solidified body of polyethylene from the reactor.

2. The method in accordance with claim 1 wherein said arm system is capable of rotating 360 degrees on said bearing.

3. The method in accordance with claim 1 wherein said arm system comprises:

(a) an arm member supported at one end by said bearing;

(b) a first support member attached at a first end to a second end of said arm member;

(c) a second support member pivotally attached to a second end of said first support member;

(d) a third support member having one end thereof pivotally attached to said second support member and a second end pivotally attached to said clamshell bucket; and (e) hydraulic means pivotally attached to said third support member and to said jaws for opening and closing said jaws.

4. The method in accordance with claim 3 wherein said first support member is tiltable from a vertical plane where pivotally attached at said first end to said second end of said arm member.

5. The method in accordance with claim 4 wherein said first support member is tiltable from the vertical plane up to 30 degrees.

6. The method in accordance with claim 3 wherein said second support member is a telescopic support member providing telescopic movement of said clamshell bucket.

7. The method in accordance with claim 3 wherein said second support member is tiltable through an angle of 138 where pivotally attached to said first support member.

8. The method in accordance with claim 3 wherein said third support member is tiltable through an angle of 120 degrees where pivotally attached to said second support member.

9. The method in accordance with claim 1 wherein said hydraulic means is operated by controls outside said reactor.

10. A method of removing a solidified body of polyethylene from a reactor used for making polyethylene from ethylene gas and a catalyst, the solidified body resulting from overheating of the reactor, melting or agglomerating polyethylene particles into said solidified body, the method comprising:

(a) providing a reactor having a lower chamber and an upper chamber, said lower chamber having portholes therein and said upper chamber having a top porthole, said solidified body of polyethylene having a surface and contained in said lower chamber;

(b) extending a robotic apparatus through said top porthole, said apparatus adapted to extend to said surface of the solidified body of polyethylene, said apparatus comprising:

(i) a shaft extending through said top porthole into said reactor, said shaft movable upwardly and downwardly through said porthole using vertical drive;

(ii) legs attached to a lower portion of said shaft inside said reactor, said legs adapted to extend to an inside wall of said reactor for purposes of limiting lateral movement of said shaft;

(iii) a bearing provided on a lower end of said shaft, said bearing supporting an arm member having a first end attached thereto;

(iv) a first support member attached at a first end to said arm member;

(v) a second support member rotatably attached to a second end of said first support member;

(vi) a third support member having one end thereof rotatably attached to said second support member and a second end rotatably attached to a clamshell bucket apparatus comprised of two jaws;

(vii) hydraulic means rotatably attached to said third support and to said jaws adapted for opening and closing said jaws; and (viii) spray means for cooling polyethylene during cutting;

(c) manipulating said robotic apparatus to cut a portion of said solidified body of polyethylene using said jaws; and (d) removing said portion of said polyethylene body from said reactor through the portholes in said lower chamber, thereby removing said solidified body of polyethylene from the reactor.

11. The method in accordance with claim 10 wherein said arm member is capable of rotating 360 degrees on said bearing.

12. The method in accordance with claim 10 wherein said first support member is tiltable from a vertical plane where rotatably attached at said first end to said arm member.

13. The method in accordance with claim 12 wherein said first support member is tiltable from the vertical plane up to 30 degrees.

14. The method in accordance with claim 10 wherein said second support member is a telescopic support member providing telescopic movement of said clamshell bucket.

15. The method in accordance with claim 10 wherein said second support member is tiltable through an angle of 138 degrees at a point where rotatably attached to said first support member.

16. The method in accordance with claim 10 wherein said third support member is tiltable through an angle of 120 degrees at a point where rotatably attached to said second support member.

17. The method in accordance with claim 10 wherein said hydraulic means is operated by controls outside said reactor.

* * * * *